US009612097B1

(12) United States Patent
Gross

(10) Patent No.: US 9,612,097 B1
(45) Date of Patent: Apr. 4, 2017

(54) BULLET TOTE

(71) Applicant: PROVIDENTIAL INNOVATIONS, LLC, Fort Mill, SC (US)

(72) Inventor: Robert R. Gross, Fort Mill, SC (US)

(73) Assignee: PROVIDENTIAL INNOVATIONS, LLC, Fort Mill, SC (US)

( * ) Notice: Subject to any disclaimer, the term of this patent is extended or adjusted under 35 U.S.C. 154(b) by 0 days.

(21) Appl. No.: 14/944,792

(22) Filed: Nov. 18, 2015

Related U.S. Application Data

(60) Provisional application No. 62/125,396, filed on Jan. 20, 2015.

(51) Int. Cl.

| | |
|---|---|
| ***F42B 39/26*** | (2006.01) |
| ***B65D 25/04*** | (2006.01) |
| ***B65D 43/02*** | (2006.01) |
| ***B65D 81/05*** | (2006.01) |

(52) U.S. Cl.
CPC ..... *F42B 39/26* (2013.01); *B65D 25/04* (2013.01); *B65D 43/02* (2013.01); *B65D 81/051* (2013.01)

(58) Field of Classification Search
CPC ..... F41A 9/26; F41A 9/27; F41A 9/28; F41A 9/85; F41A 9/84; F42B 39/00; F42B 39/002; F42B 39/26
See application file for complete search history.

(56) References Cited

U.S. PATENT DOCUMENTS

| | | | | | |
|---|---|---|---|---|---|
| 202,613 | A | * | 4/1878 | White | F41A 9/72 42/87 |
| 331,891 | A | * | 12/1885 | Kelton | F41A 9/85 42/89 |
| 394,373 | A | * | 12/1888 | Kelton | F41A 9/85 42/89 |
| 516,942 | A | | 3/1894 | Prideaux | |
| 527,166 | A | * | 10/1894 | Watson | F41A 9/85 42/89 |
| 1,181,034 | A | * | 4/1916 | Prideaux | F41A 9/85 42/89 |
| 1,228,505 | A | * | 6/1917 | Wesson | F41A 9/85 42/89 |
| 1,964,171 | A | * | 6/1934 | Pflaume | F41A 9/85 42/89 |
| 2,396,184 | A | * | 3/1946 | Lima | F41A 9/85 206/3 |
| 2,399,904 | A | * | 5/1946 | Baucum | F41A 9/85 224/239 |
| 2,620,584 | A | * | 12/1952 | Edmands | F41A 9/85 42/89 |
| 2,637,930 | A | * | 5/1953 | Mason | F41A 9/85 42/89 |
| 2,896,353 | A | * | 7/1959 | Hunt | F41A 9/85 42/89 |
| 3,398,848 | A | * | 8/1968 | Donovan | B65D 50/048 215/224 |

(Continued)

*Primary Examiner* — Derrick Morgan
(74) *Attorney, Agent, or Firm* — Hayes Soloway P.C.

(57) ABSTRACT

A bullet tote includes a hollow structure, closed at one end, and having a removable top at the other end. The interior of the hollow structure contains a separator or dividers for holding and aligning bullets essentially to match a spacing and alignment of a firearms chamber or cylinder so that the bullets may be dumped directly into a firearm chamber or cylinder.

12 Claims, 4 Drawing Sheets

(56) References Cited

U.S. PATENT DOCUMENTS 3,667,146 A * 6/1972 Dupouy ..... F41A 9/85 42/89
3,769,732 A * 11/1973 Griffis ..... F41A 9/85 42/89
3,769,733 A * 11/1973 Nelson ..... F41A 9/85 224/239
3,890,733 A * 6/1975 Kubik ..... F42B 39/00 224/673
4,079,536 A * 3/1978 Hunt ..... F41A 9/85 42/89
4,194,657 A * 3/1980 Thor ..... A45F 5/02 206/3
4,272,903 A * 6/1981 Griffis ..... F42B 39/02 42/89
4,318,239 A * 3/1982 Phillips, Jr. ..... F41A 15/02 42/61
4,325,198 A * 4/1982 Muck ..... F41A 9/85 42/89
4,408,707 A * 10/1983 Rogers ..... F42B 39/02 224/239
4,437,252 A * 3/1984 Castellanos Manero . F41A 9/85 42/89
4,483,089 A * 11/1984 Johnson ..... F41A 9/85 224/674
4,572,415 A * 2/1986 Fehr ..... F41A 9/85 224/675
4,657,132 A * 4/1987 Abdo ..... F42B 39/02 206/3
4,697,368 A * 10/1987 Williams ..... F41C 23/22 42/59
4,866,870 A * 9/1989 Johnson ..... F41A 9/85 42/89
5,548,916 A * 8/1996 Kinsel ..... F41A 9/85 42/89
6,651,372 B2 * 11/2003 Del Fatti ..... F42B 39/02 224/239
6,688,504 B1 * 2/2004 Kirkaldy ..... A45F 5/021 224/196
7,137,218 B1 * 11/2006 Adkins, Jr. ..... F41C 9/085 102/522
8,448,814 B2 * 5/2013 Yamamoto ..... B65D 43/0204 220/315
2005/0116003 A1 * 6/2005 Butler ..... A45C 11/22 224/604
2006/0101698 A1 * 5/2006 Lin ..... F41A 9/85 42/89
2007/0044363 A1 * 3/2007 McClellan ..... F41A 9/85 42/87
2011/0138672 A1 * 6/2011 Abell ..... F41A 9/85 42/89
2011/0233076 A1 * 9/2011 Potterfield ..... B65D 21/0219 206/3
2011/0318232 A1 * 12/2011 Patcheak ..... B01J 7/02 422/129
2012/0241450 A1 * 9/2012 Domburg ..... B44D 3/127 220/200
2013/0036643 A1 * 2/2013 Lawing ..... F41C 3/14 42/59
2014/0202884 A1 * 7/2014 Martin, III ..... F41A 9/85 206/3
2015/0021216 A1 * 1/2015 Blagojevic ..... B65D 53/00 206/223
2016/0075492 A1 * 3/2016 Brannock ..... B65D 43/0212 220/712
2016/0130063 A1 * 5/2016 Demery ..... B65D 43/0212 220/200
2016/0136049 A1 * 5/2016 Weinstein ..... A61J 1/16 206/570
2016/0137386 A1 * 5/2016 Pontes García et al. ..... B65B 29/10 206/221

* cited by examiner

BULLET TOTE

CROSS REFERENCE TO RELATED APPLICATIONS

This application claims priority from U.S. Provisional Application Ser. No. 62/125,396, filed Jan. 20, 2015. The contents of which are incorporated herein by reference.

FIELD OF THE INVENTION

This application relates to bullet totes, and more particularly to totes for holding bullets for convenient carry of spare bullets and for speed loading of firearms. The invention has particular utility as a bullet tote and speed loader for revolvers and will be described in connection with such utility. However, the invention is not so limited, and may be used as a bullet tote and loader for all types of firearms including rifles.

Bullets used in revolvers typically are held loose in pockets, or in pouches, or in speed loaders or strip loaders. While speed loaders are preferred by many, speed loaders generally firmly hold bullets but generally don't protect the bullets, conceal the bullets, or provide for convenient concealed carry. Strip loaders hold the bullets in strips, but like speed loaders generally don't protect the bullets, conceal the bullets or provide for convenient concealed carry. Semiautomatic handguns typically use magazines and spare magazines to hold spare bullets and provide for fast reloads. But a bullet misfire, or bullet jamming in semiautomatic pistols causes many users to favor a compact revolver because of greatly improved reliability.

SUMMARY OF THE INVENTION

The present invention overcomes the aforesaid and other advantages of the prior art by providing a bullet tote for carrying, spare bullets, which facilitates quick reload, and which protects and conceals the bullets. Bullets typically are small for compact revolvers, and compact revolvers are common for concealed carry. Because of the limited number of bullets (or shells) held in compact revolvers, and the typical small caliber of the bullets, carrying spare bullets for reloading is desirable. Even so, whether the revolver is small or large, many who carry a hand gun, like to carry spare bullets, and also want to be able to reload the revolver quickly. The present invention provides a bullet tote and speed loader containing a complete set of spare bullets for fast reload of revolvers, of any size. The bullet tote of the present invention also can be used to hold spare bullets for rifles, single shot pistols, a derringer bullet chamber, or spare bullets for semiautomatic pistols or other firearms.

More particularly, the present invention provides a hollow structure closed at one end, and having a removable top or cap at the other end. The interior of the hollow structure contains a separator or dividers for holding and aligning bullets essentially to match the spacing and alignment of a firearm chamber or cylinder so that the bullets may be dumped directly into a firearm chamber or cylinder. The top or cap is releasably held on the hollow structure. In a preferred embodiment, the hollow structure is cylindrically shaped, and the top or cap is held on the hollow structure by screw threads or a bayonet type fitting. The interior separator may comprise a separate insert or may be integrally formed within the cylinder, e.g. by molding.

In another embodiment of the invention, for example, for small North American Arms type guns, the bullet tote could be placed on a key-chain, or key-ring. In such embodiment, the bullet tote may include a boss, hole or other structure for affixing to a key-chain or key-ring.

In yet another embodiment the bullet tote has a smooth outside so that it may be carried in a pocket.

In still yet another embodiment the bullet tote is designed to be attached to a belt, pack or clothing. In such embodiment, the bullet tote may include a clip or one half of a hook and loop fabric, for attachment to packs, clothing or other objects carried on a person.

In a preferred embodiment the bullet tote holds the bullets in alignment for a firearm cylinder or chamber for facilitating fast reload time. In such embodiment, the bullet tote, once opened, allows for pouring or dumping of the bullets, all at once, into a firearm cylinder or chamber.

In another and preferred embodiment the bullet alignment in the bullet tote with the matching revolver cylinder or chamber is almost perfect so as to make pouring the bullets into the cylinder or chamber as easy as possible. However, bullet alignment with matching revolver cylinder or chamber need not be almost perfect, but merely close enough, i.e. approximately aligned to make pouring or dumping into a firearm cylinder or chamber practical.

In yet another embodiment of the invention, the bullet tote may include padding to hold the bullets and prevent rattling.

The feature advantage of the present invention is that the bullets are held separately from one another whereby to prevent wear.

As will be described below, the bullet tote also may be used to carry bullets for various firearm types, not just revolvers.

BRIEF DESCRIPTION OF THE DRAWINGS

Further features and advantages of the present invention will be seen from the following detailed description, taken in conjunction with the accompanying drawings, wherein.

DETAILED DESCRIPTION OF PREFERRED EMBODIMENTS

Figure 1:
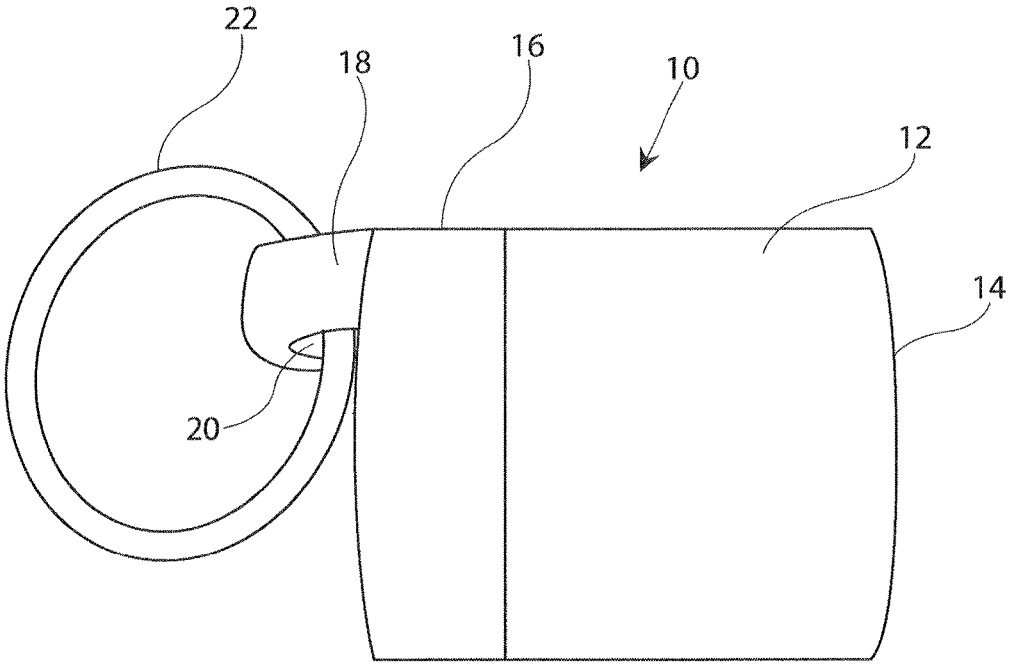
FIG. 1 is a side elevational view of a bullet tote in accordance with the present invention.

According to FIGS. 1-4 a bullet tote 10 in accordance with the present invention comprises a hollow structure, preferably in the form of an elongate cylinder 12 closed at one end 14 and capped at the other end by a removable cap 16. Cap 16 includes a boss 18 having a hole 20 for accommodating a key-ring 22. Cap 16 is threaded onto cylinder 12. Alternatively, cover 16 may be removably attached to cylinder 12 by a bayonet fitting, or other form of slots and tabs, or top 16 may be press (friction) fitted to cylinder 12. Alternatively, for one time use, cap 16 may be affixed to cylinder 12 by adhesive or by a frangible web.

Figure 3:
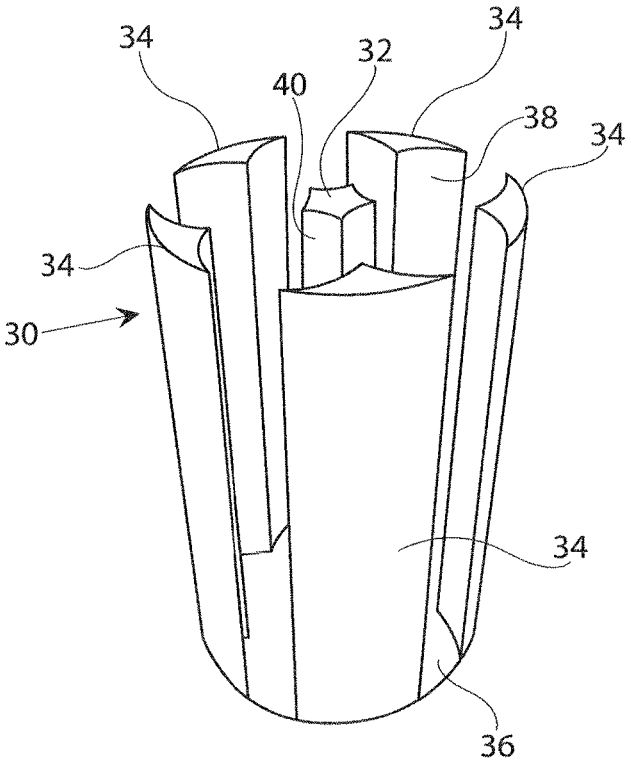
FIG. 3 is a perspective view showing a first embodiment of a bullet separator of the bullet tote of the present invention.
Figure 4:
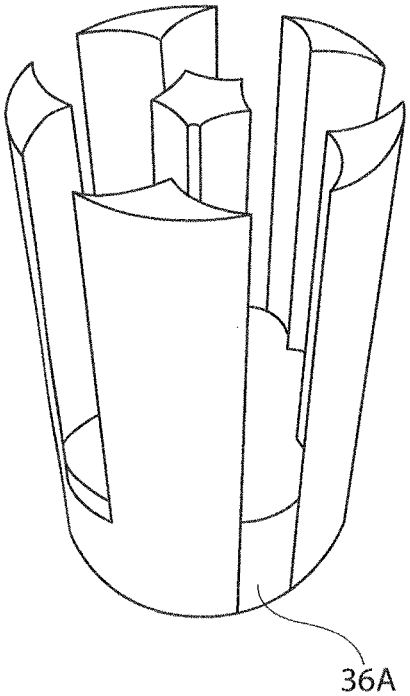
FIG. 4 shows an alternative embodiment of a bullet separator in accordance with the present invention.

Referring in particular to FIG. 3, the interior of cylinder 12 is divided into a plurality of bullet slots, by an insert 30 comprising a central post 32 and a plurality of outside members 34 mounted to a base 36. Members 34 and post 32 include scalloped sides 38, 40 respectively, for accommodating bullets 42. The insert shown in FIG. 3 is sized and shaped to accommodate 22 mag bullets. The insert shown in FIG. 4 is similar to the insert shown in FIG. 3, except the base 36*a* is thicker, so as to accommodate conventional 22LR bullets. Insert 30 may comprise a separate element, or may be formed integrally with cylinder 12, e.g., by molding.

Figure 2:
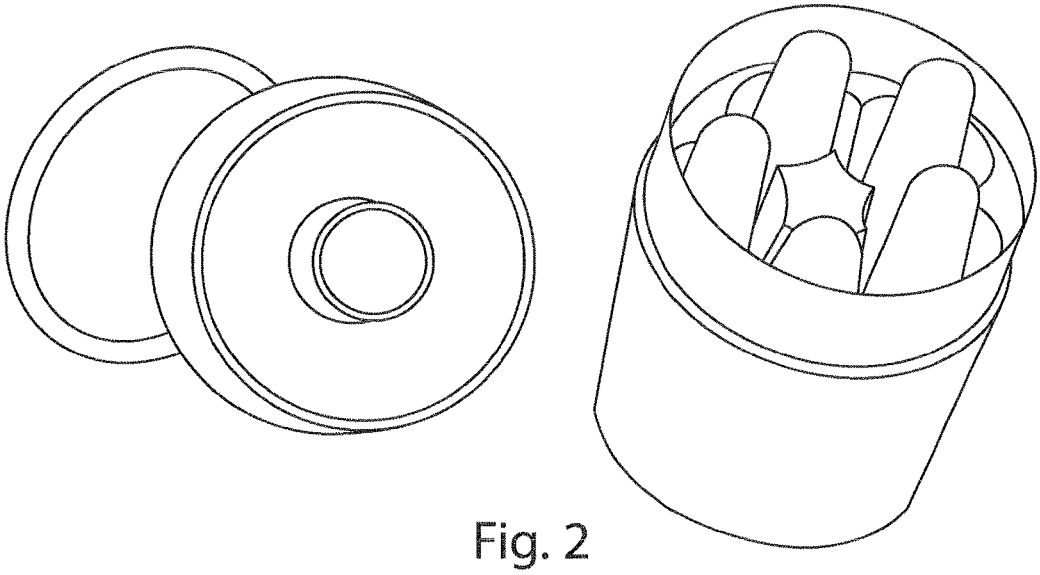
FIG. 2 is a perspective view drawing of the bullet tote of FIG. 1 opened and ready to load an empty revolver cylinder.
Figure 5:
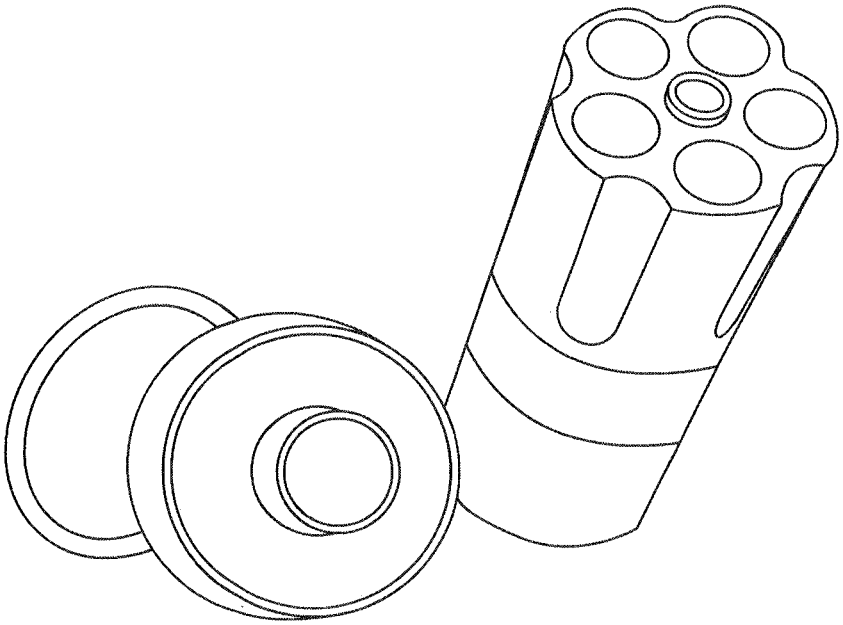
FIG. 5 illustrates first step in filling an empty revolver cylinder in accordance with the present invention.
Figure 6:
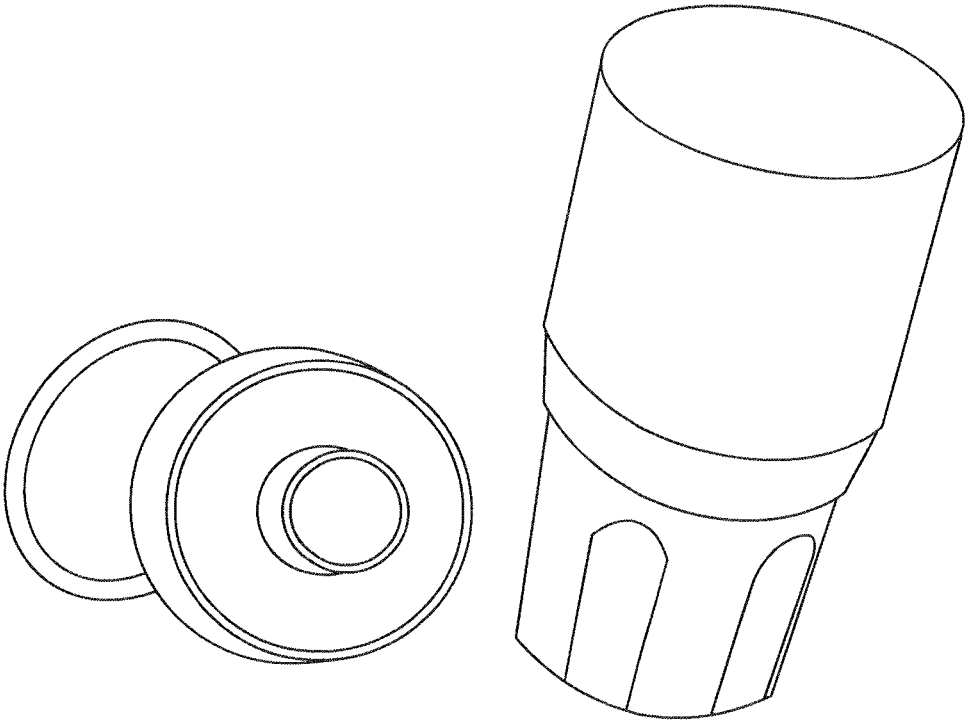
FIG. 6 shows a second step in filling an empty revolver cylinder with bullets in accordance with the present invention.
Figure 7:
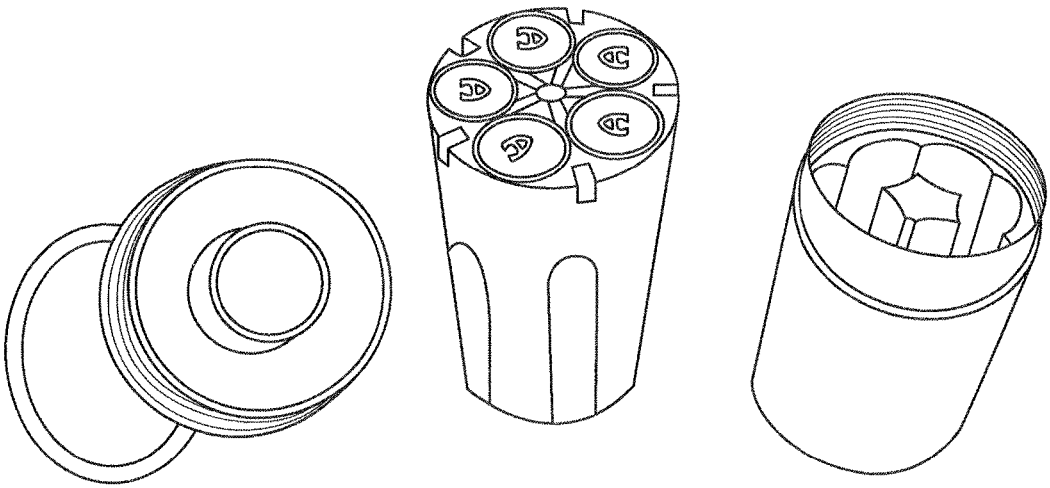
FIG. 7 shows a revolver cylinder filled with bullets in accordance with the present invention.

Referring also to FIGS. 5-7, use of the bullet tote in accordance with the present invention will now be described. A bullet tote is filled with bullets as illustrated in FIG. 2. A revolver empty cylinder is placed over an open bullet tote as shown in FIG. 5 and the bullet tote and empty cylinder are tipped over as shown in FIG. 6. The bullets quickly load into the empty cylinder under the influence of gravity. FIG. 7 shows the loaded cylinder and the empty bullet tote.

Various changes may be made in the above invention without departing from the spirit and scope of the invention. For example, cap 16 may be affixed directly to central port 32, in which case the outer walls of cylinder 12 may be eliminated, at least in part, so that the user can visually see immediately, if he has a full re-load. Also, the outer wall of cylinder 12 may take other forms from that of a right cylinder, and may be, for example, pentagonal or other segmented shape.

What is claimed:

1. A bullet tote comprising:

a hollow structure closed at one end and having a removable cap at the other end; and an insert fixed in the hollow structure and dividing the interior of the hollow structure into a plurality of bullet slots, sized and shaped to slidably hold bullets essentially aligned to match a spacing and alignment of a firearm chamber or cylinder, wherein said bullets are arranged with a projectile end near the cap end of the hollow structure and are retained within said hollow structure by said removable cap, and wherein the tote is filled with bullets, and wherein the bullets are approximately aligned for freely pouring or dumping into a firearm chamber or cylinder under the force of gravity, leaving the insert in the hollow structure.

2. The bullet tote of claim 1, wherein the cap is held to the hollow structure by threading, a bayonet fitting, or slots and tabs.

3. The bullet tote of claim 1, wherein the cap is press fitted to the hollow structure.

4. The bullet tote of claim 1, wherein the cap is fixed to the hollow structure by adhesive or by a frangible web.

5. The bullet tote of claim 1, wherein the bullet tote further comprises a boss or hole or other structure for affixing to a key-chain or key-ring.

6. The bullet tote of claim 1, further including a clip or one half of a hook and loop fabric so that the bullet tote may be attached to a pack, clothing or other object carried on a person.

7. The bullet tote of claim 1, loaded with bullets, wherein the bullets are essentially perfectly aligned for dumping into a firearm chamber or cylinder.

8. The bullet tote of claim 1, further including collapsible padding to hold the bullets and prevent rattling.

9. The bullet tote of claim 1, wherein the hollow structure includes a continuous outer wall.

10. The bullet tote of claim 1, wherein the bullets are at least partially exposed by gaps in the hollow structure sized to allow inspection of bullets contained within the bullet tote.

11. A method for storing bullets comprising providing a bullet tote as claimed in claim 1, and loading the bullet tote with bullets.

12. A method of reloading a firearm comprising providing a bullet tote as claimed in claim 1, loaded with bullets, removing the cap, placing a firearm cylinder or chamber over the uncapped bullet tote, and inverting the bullet tote and firearm cylinder or chamber and dumping the bullets from the bullet tote into the firearm cylinder or chamber.

* * * * *